US010609484B2

(12) United States Patent
Family et al.

(10) Patent No.: US 10,609,484 B2
(45) Date of Patent: Mar. 31, 2020

(54) AUDIO SYSTEM WITH CONFIGURABLE ZONES

(71) Applicant: Apple Inc., Cupertino, CA (US)

(72) Inventors: Afrooz Family, Emerald Hills, CA (US); Anthony P. Bidmead, Los Gatos, CA (US); Erik L. Wang, Redwood City, CA (US); Gary P. Geaves, Cupertino, CA (US); Martin E. Johnson, Los Gatos, CA (US); Matthew I. Brown, San Francisco, CA (US); Michael B. Howes, San Jose, CA (US); Sylvain J. Choisel, San Palo Alto, CA (US); Tomlinson M. Holman, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 258 days.

(21) Appl. No.: 15/684,790

(22) Filed: Aug. 23, 2017

(65) Prior Publication Data

US 2017/0374465 A1 Dec. 28, 2017

Related U.S. Application Data

(63) Continuation of application No. 15/513,141, filed as application No. PCT/US2014/057884 on Sep. 26, 2014, now abandoned.

(51) Int. Cl.
*H04S 7/00* (2006.01)
*H04R 3/12* (2006.01)
(Continued)

(52) U.S. Cl.
CPC ..... *H04R 3/12* (2013.01); *H04S 7/30* (2013.01); *H04S 7/302* (2013.01); *H04S 7/303* (2013.01); *G10L 19/008* (2013.01); *H04R 27/00* (2013.01)

(58) Field of Classification Search
CPC H04R 3/00–14; H04R 27/00–04; H04R 1/40; H04R 5/04; H04R 2227/003;
(Continued)

(56) References Cited

U.S. PATENT DOCUMENTS 7,346,332 B2 3/2008 McCarty et al.
7,483,538 B2 1/2009 McCarty et al.
(Continued)

FOREIGN PATENT DOCUMENTS

AU 2017202717 B2 5/2018
CN 1507701 A 6/2004
(Continued)

OTHER PUBLICATIONS

PCT International Search Report and Written Opinion for PCT International Appln No. PCT/US2014/057884 dated May 20, 2015 (9 pages).
(Continued)

*Primary Examiner* — Leshui Zhang
(74) *Attorney, Agent, or Firm* — Womble Bond Dickinson (US) LLP

(57) ABSTRACT

An audio system is described that includes one or more speaker arrays that emit sound corresponding to one or more pieces of sound program content into associated zones within a listening area. Using parameters of the audio system (e.g., locations of the speaker arrays and the audio sources), the zones, the users, the pieces of sound program content, and the listening area, one or more beam pattern attributes may be generated. The beam pattern attributes define a set of beams that are used to generate audio beams for channels of sound program content to be played in each zone. The beam pattern attributes may be updated as changes are detected within the listening environment. By adapting to these changing conditions, the audio system is capable of repro-
(Continued)

ducing sound that accurately represents each piece of sound program content in various zones.

24 Claims, 14 Drawing Sheets

(51) Int. Cl.
*H04R 27/00* (2006.01)
*G10L 19/008* (2013.01)

(58) Field of Classification Search
CPC .... H04S 1/00–7/00; H04S 7/30; H04S 7/302; H04S 7/303; H04S 5/00; H04S 7/305; H04S 7/304; H04S 1/007; H04S 2400/03; H04S 2400/11; H04S 2400/15; H04S 2420/03; H04S 2420/11; H04S 3/008; H04S 2420/01; G10L 19/008; G10L 19/22; G10L 19/24; H04M 3/56; H04M 1/72572; H04M 3/53366; H04M 9/085; H04M 1/72519; H04M 1/72547; H04M 1/72522; H04M 1/72583; H04M 1/0214; G06F 3/03547; G06F 2203/041; G06F 3/0412; G06F 3/0414; G06F 3/0416; G06F 3/0418; G06F 3/046; G06F 3/047; H05K 9/0073; H05K 9/0079; H05K 9/0081; H05K 9/0088
USPC ..... 381/300–308, 61, 59, 77, 80, 31, 82, 83, 381/85, 86, 87, 89, 332, 333, 336, 111, 381/116, 117, 118, 119, 123; 700/94; 455/566; 345/173
See application file for complete search history.

(56) References Cited

U.S. PATENT DOCUMENTS

| | | | | |
|---|---|---|---|---|
| 7,853,341 | B2 | 12/2010 | McCarty et al. | |
| 7,970,153 | B2 | 6/2011 | Konagai et al. | |
| 8,103,009 | B2 | 1/2012 | McCarty et al. | |
| 8,290,603 | B1 | 10/2012 | Lambourne | |
| 8,483,853 | B1 | 7/2013 | Lambourne | |
| 8,843,228 | B2 | 9/2014 | Lambourne | |
| 9,141,645 | B2 | 9/2015 | Lambourne et al. | |
| 9,344,206 | B2 | 5/2016 | Lambourne | |
| 9,348,824 | B2 | 5/2016 | Coburn, IV | |
| 9,671,997 | B2 | 6/2017 | Triplett | |
| 9,913,011 | B1 | 3/2018 | Giuliani et al. | |
| 2006/0204022 | A1* | 9/2006 | Hooley | H04R 1/403 381/117 |
| 2006/0233382 | A1 | 10/2006 | Watanabe | |
| 2007/0025562 | A1 | 2/2007 | Zalewski et al. | |
| 2012/0170762 | A1* | 7/2012 | Kim | H04R 3/12 381/59 |
| 2014/0006017 | A1 | 1/2014 | Sen | |
| 2015/0208166 | A1* | 7/2015 | Raghuvanshi | H04R 3/002 381/71.6 |

FOREIGN PATENT DOCUMENTS

| | | | |
|---|---|---|---|
| CN | 1857031 | A | 11/2006 |
| CN | 101874414 | A | 10/2010 |
| CN | 102860041 | A | 1/2013 |
| CN | 107148782 | A | 9/2017 |
| EP | 3248389 | A1 | 11/2017 |
| JP | 10-262300 | A | 9/1998 |
| JP | 11-027604 | A | 1/1999 |
| JP | 2007-124129 | A | 5/2007 |
| JP | 2008-035251 | A | 2/2008 |
| JP | 2008-160265 | A | 7/2008 |
| JP | 2009-017094 | A | 1/2009 |
| JP | 2012-065007 | A | 3/2012 |
| JP | 2007-208318 | A | 8/2017 |
| JP | 2017-532898 | A | 11/2017 |
| KR | 10-2017-0094125 | A | 8/2017 |
| WO | 2014036085 | A1 | 3/2014 |
| WO | WO 2014/151817 | A1 | 9/2014 |
| WO | WO-2014151817 | | 9/2014 |
| WO | 2016/048381 | A1 | 3/2016 |
| WO | 2016048381 | A1 | 3/2016 |

OTHER PUBLICATIONS

European Patent Office—Notification and European Search Report by European Searching Authority—dated Apr. 9, 2018 for related European Patent Application No. 17186626.6 (3301947), 10 pages.
Chinese Office Action dated Apr. 2, 2019 for related Chinese Patent Applicaiton No. 201480083576.7 11 Pages.
Korean Intellectual Property Office Notice of Preliminary Rejection for Korean Patent Appin No. 10-2018-7034845 dated Jan. 17, 2019.
U.S. Unpublished Patent Application filed on Mar. 21, 2017 by Family et al., entitled "Audio System With Configurable Zones", U.S. Appl. No. 15/513,141.
Office Action received for Japanese Patent Application No. 2017-516655, dated May 18, 2018, 6 pages (3 pages of English Translation and 3 pages of Office Action).
PCT International Preliminary Report on Patentability for PCT/US2014/057884, dated Apr. 6, 2017.
Apple Inc., Australian Office Action dated Feb. 2, 2018, AU Application No. 2017202717.
Apple Inc., Korean Office Action dated Dec. 8, 2017, KR Application No. 10-2017-7011481.
Australian Examination Report dated Aug. 27, 2019 for related Australian Appln. No. 2018214059 3 Pages.
Japanese Office Action dated Jul. 8, 2019 for related Japanese Patent Appln No. 2018-120558 9 Pages.
Second Office Action for counterpart Chinese Patent Application No. 201480083576.7 with English translation, 6 pgs. (dated Dec. 5, 2019).
Final Rejection for counterpart Japanese Patent Application No. 2018-120558 with English translation, 9 pgs. (dated Jan. 6, 2020).
Last Preliminary Rejection for counterpart Korean Patent Application No. 10-2018-7034845 with English translation, 11 pgs., (dated Aug. 28, 2019).

* cited by examiner

AUDIO SYSTEM WITH CONFIGURABLE ZONES

This Application is a continuation of co-pending U.S. application Ser. No. 15/513,141, filed Mar. 21, 2017, which is a U.S. National Phase Application under 35 U.S.C. § 371 of International Application No. PCT/US2014/057884, filed Sep. 26, 2014.

FIELD

An audio system that is configurable to output audio beams representing channels for one or more pieces of sound program content into separate zones based on the positioning of users, audio sources, and/or speaker arrays is disclosed. Other embodiments are also described.

BACKGROUND

Speaker arrays may reproduce pieces of sound program content to a user through the use of one or more audio beams. For example, a set of speaker arrays may reproduce front left, front center, and front right channels for a piece of sound program content (e.g., a musical composition or an audio track for a movie). Although speaker arrays provide a wide degree of customization through the production of audio beams, conventional speaker array systems must be manually configured each time a new speaker array is added to the system, a speaker array is moved within a listening environment/area, an audio source is added/changed, or any other change is made to the listening environment. This requirement for manual configuration may be burdensome and inconvenient as the listening environment continually changes (e.g., speaker arrays are added to a listening environment or are moved to new locations within the listening environment). Further, these conventional systems are limited to playback of a single piece of sound program content through the single set of speaker arrays.

SUMMARY

An audio system is disclosed that includes one or more speaker arrays that emit sound corresponding to one or more pieces of sound program content into associated zones within a listening area. In one embodiment, the zones correspond to areas within the listening area in which associated pieces of sound program content are designated to be played within. For example, a first zone may be defined as an area where multiple users are situated in front of a first audio source (e.g., a television). In this case, the sound program content produced and/or received by the first audio source is associated with and played back into the first zone. Continuing on this example, a second zone may be defined as an area where a single user is situated proximate to a second audio source (e.g., a radio). In this case, the sound program content produced and/or received by the second audio source is associated with the second zone.

Using parameters of the audio system (e.g., locations of the speaker arrays and the audio sources), the zones, the users, the pieces of sound program content, and/or the listening area, one or more beam pattern attributes may be generated. The beam pattern attributes define a set of beams that are used to generate audio beams for channels of sound program content to be played in each zone. For example, the beam pattern attributes may indicate gain values, delay values, beam type pattern values, and beam angle values that may be used to generate beams for each zone.

In one embodiment, the beam pattern attributes may be updated as changes are detected within the listening area. For example, changes may be detected within the audio system (e.g., movement of a speaker array) or within the listening area (e.g., movement of users). Accordingly, sound produced by the audio system may continually account for the variable conditions of the listening environment. By adapting to these changing conditions, the audio system is capable of reproducing sound that accurately represents each piece of sound program content in various zones.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1A:
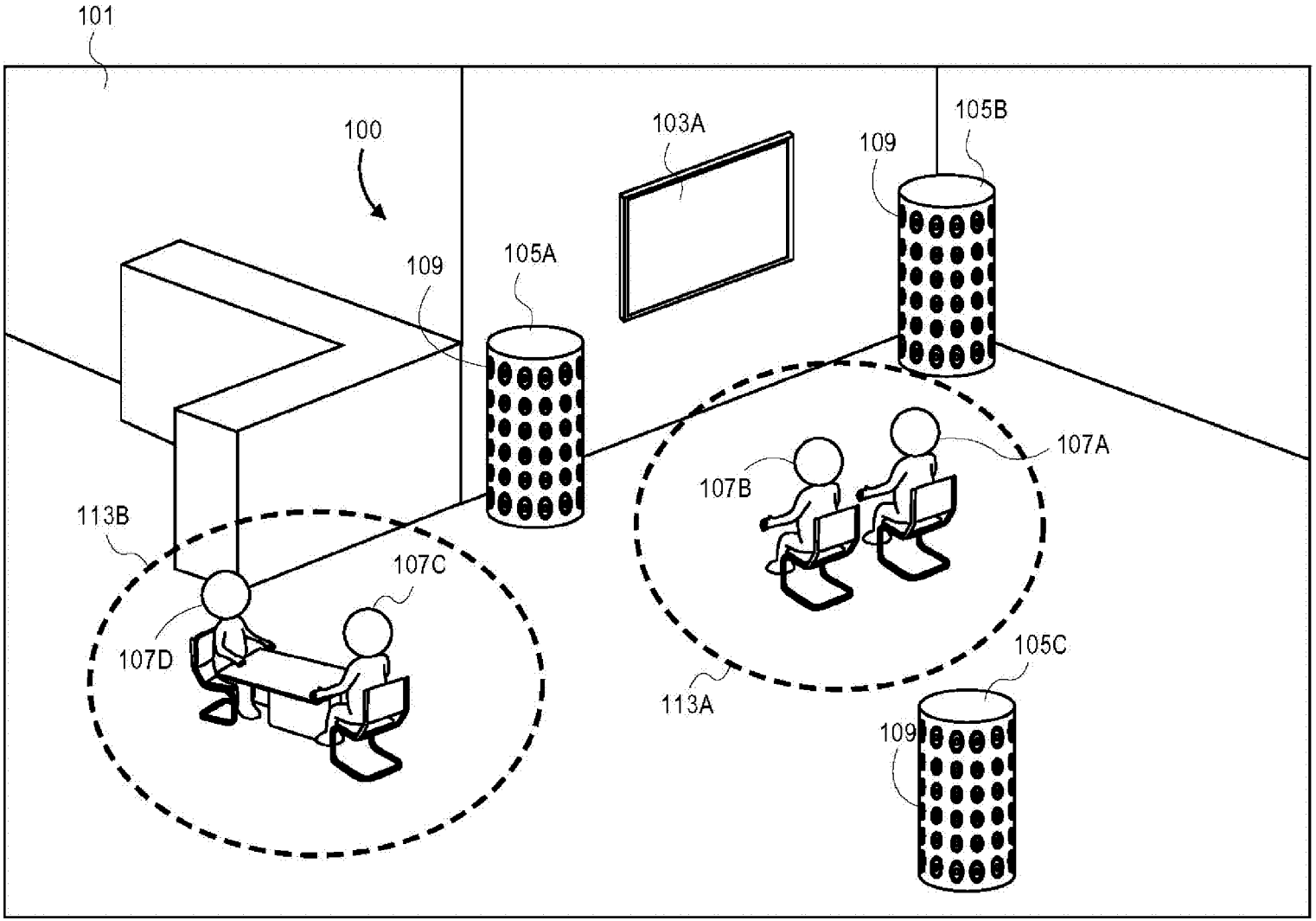
FIG. 1A shows a view of an audio system within a listening area according to one embodiment.

FIG. 1A shows a view of an audio system 100 within a listening area 101. The audio system 100 may include an audio source 103A and a set of speaker arrays 105. The audio source 103A may be coupled to the speaker arrays 105 to drive individual transducers 109 in the speaker array 105 to emit various sound beam patterns for the users 107. In one embodiment, the speaker arrays 105 may be configured to generate audio beam patterns that represent individual channels for multiple pieces of sound program content. Playback of these pieces of sound program content may be aimed at separate audio zones 113 within the listening area 101. For example, the speaker arrays 105 may generate and direct beam patterns that represent front left, front right, and front center channels for a first piece of sound program content to a first zone 113A. In this example, one or more of the same speaker arrays 105 used for the first piece of sound program content may simultaneously generate and direct beam patterns that represent front left and front right channels for a second piece of sound program content to a second zone 113B. In other embodiments, different sets of speaker arrays 105 may be selected for each of the first and second zones 113A and 113B. The techniques for driving these speaker arrays 105 to produce audio beams for separate pieces of sound program content and corresponding separate zones 113 will be described in greater detail below.

As shown in FIG. 1A, the listening area 101 is a room or another enclosed space. For example, the listening area 101 may be a room in a house, a theatre, etc. Although shown as an enclosed space, in other embodiments, the listening area 101 may be an outdoor area or location, including an outdoor arena. In each embodiment, the speaker arrays 105 may be placed in the listening area 101 to produce sound that will be perceived by the set of users 107.

Figure 2A:
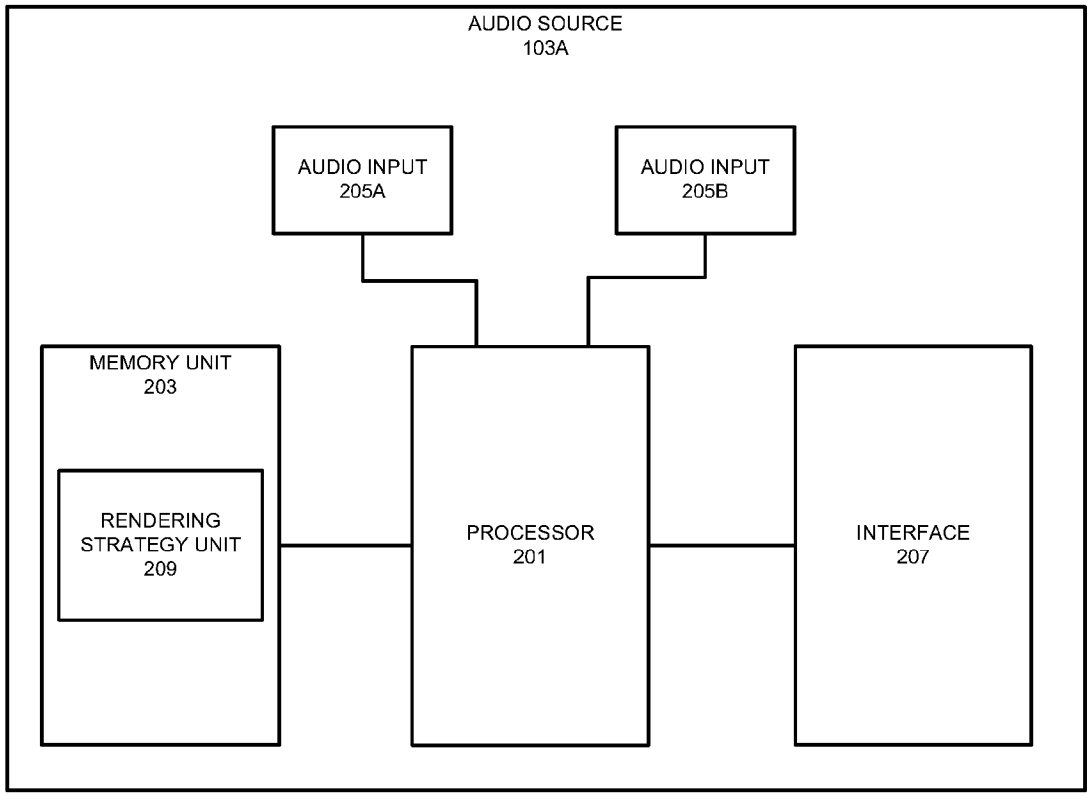
FIG. 2A shows a component diagram of an audio source according to one embodiment.

FIG. 2A shows a component diagram of an example audio source 103A according to one embodiment. As shown in FIG. 1A, the audio source 103A is a television; however, the audio source 103A may be any electronic device that is capable of transmitting audio content to the speaker arrays 105 such that the speaker arrays 105 may output sound into the listening area 101. For example, in other embodiments the audio source 103A may be a desktop computer, a laptop computer, a tablet computer, a home theater receiver, a set-top box, a personal video player, a DVD player, a Blu-ray player, a gaming system, and/or a mobile device (e.g., a smartphone).

Figure 1B:
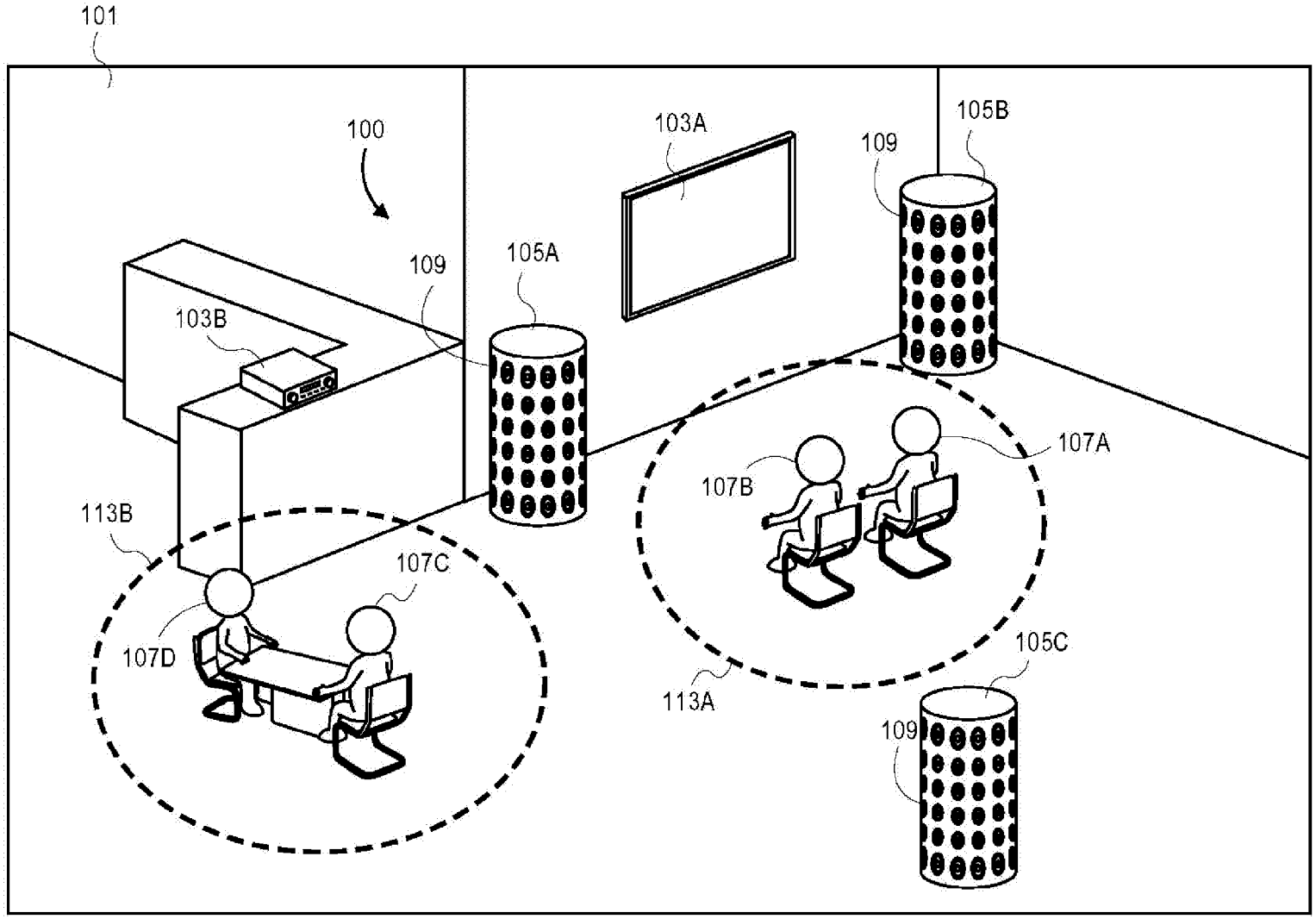
FIG. 1B shows a view of an audio system within a listening area according to another embodiment.

Although shown in FIG. 1A with a single audio source 103, in some embodiments the audio system 100 may include multiple audio sources 103 that are coupled to the speaker arrays 105. For example, as shown in FIG. 1B, the audio sources 103A and 103B may be both coupled to the speaker arrays 105. In this configuration, the audio sources 103A and 103B may simultaneously drive each of the speaker arrays 105 to output sound corresponding to separate pieces of sound program content. For example, the audio source 103A may be a television that utilizes the speaker arrays 105A-105C to output sound into the zone 113A while the audio source 103B may be a radio that utilizes the speaker arrays 105A and 105C to output sound into the zone 113B. The audio source 103B may be similarly configured as shown in FIG. 2A in relation to the audio source 103B.

As shown in FIG. 2A, the audio source 103A may include a hardware processor 201 and/or a memory unit 203. The processor 201 and the memory unit 203 are generically used here to refer to any suitable combination of programmable data processing components and data storage that conduct the operations needed to implement the various functions and operations of the audio source 103A. The processor 201 may be an applications processor typically found in a smart phone, while the memory unit 203 may refer to microelectronic, non-volatile random access memory. An operating system may be stored in the memory unit 203 along with application programs specific to the various functions of the audio source 103A, which are to be run or executed by the processor 201 to perform the various functions of the audio source 103A. For example, a rendering strategy unit 209 may be stored in the memory unit 203. As will be described in greater detail below, the rendering strategy unit 209 may be used to generate beam attributes for each channel of pieces of sound program content to be played in the listening area 101. These beam attributes may be used to output audio beams into corresponding audio zones 113 within the listening area 101.

In one embodiment, the audio source 103A may include one or more audio inputs 205 for receiving audio signals from external and/or remote devices. For example, the audio source 103A may receive audio signals from a streaming media service and/or a remote server. The audio signals may represent one or more channels of a piece of sound program content (e.g., a musical composition or an audio track for a movie). For example, a single signal corresponding to a single channel of a piece of multichannel sound program content may be received by an input 205 of the audio source 103A. In another example, a single signal may correspond to multiple channels of a piece of sound program content, which are multiplexed onto the single signal.

In one embodiment, the audio source 103A may include a digital audio input 205A that receives digital audio signals from an external device and/or a remote device. For example, the audio input 205A may be a TOSLINK connector or a digital wireless interface (e.g., a wireless local area network (WLAN) adapter or a Bluetooth receiver). In one embodiment, the audio source 103A may include an analog audio input 205B that receives analog audio signals from an external device. For example, the audio input 205B may be a binding post, a Fahnestock clip, or a phono plug that is designed to receive a wire or conduit and a corresponding analog signal.

Although described as receiving pieces of sound program content from an external or remote source, in some embodiments pieces of sound program content may be stored locally on the audio source 103A. For example, one or more pieces of sound program content may be stored within the memory unit 203.

In one embodiment, the audio source 103A may include an interface 207 for communicating with the speaker arrays 105 or other devices (e.g., remote audio/video streaming services). The interface 207 may utilize wired mediums (e.g., conduit or wire) to communicate with the speaker arrays 105. In another embodiment, the interface 207 may communicate with the speaker arrays 105 through a wireless connection as shown in FIG. 1A and FIG. 1B. For example, the network interface 207 may utilize one or more wireless protocols and standards for communicating with the speaker arrays 105, including the IEEE 802.11 suite of standards, cellular Global System for Mobile Communications (GSM) standards, cellular Code Division Multiple Access (CDMA) standards, Long Term Evolution (LTE) standards, and/or Bluetooth standards.

Figure 2B:
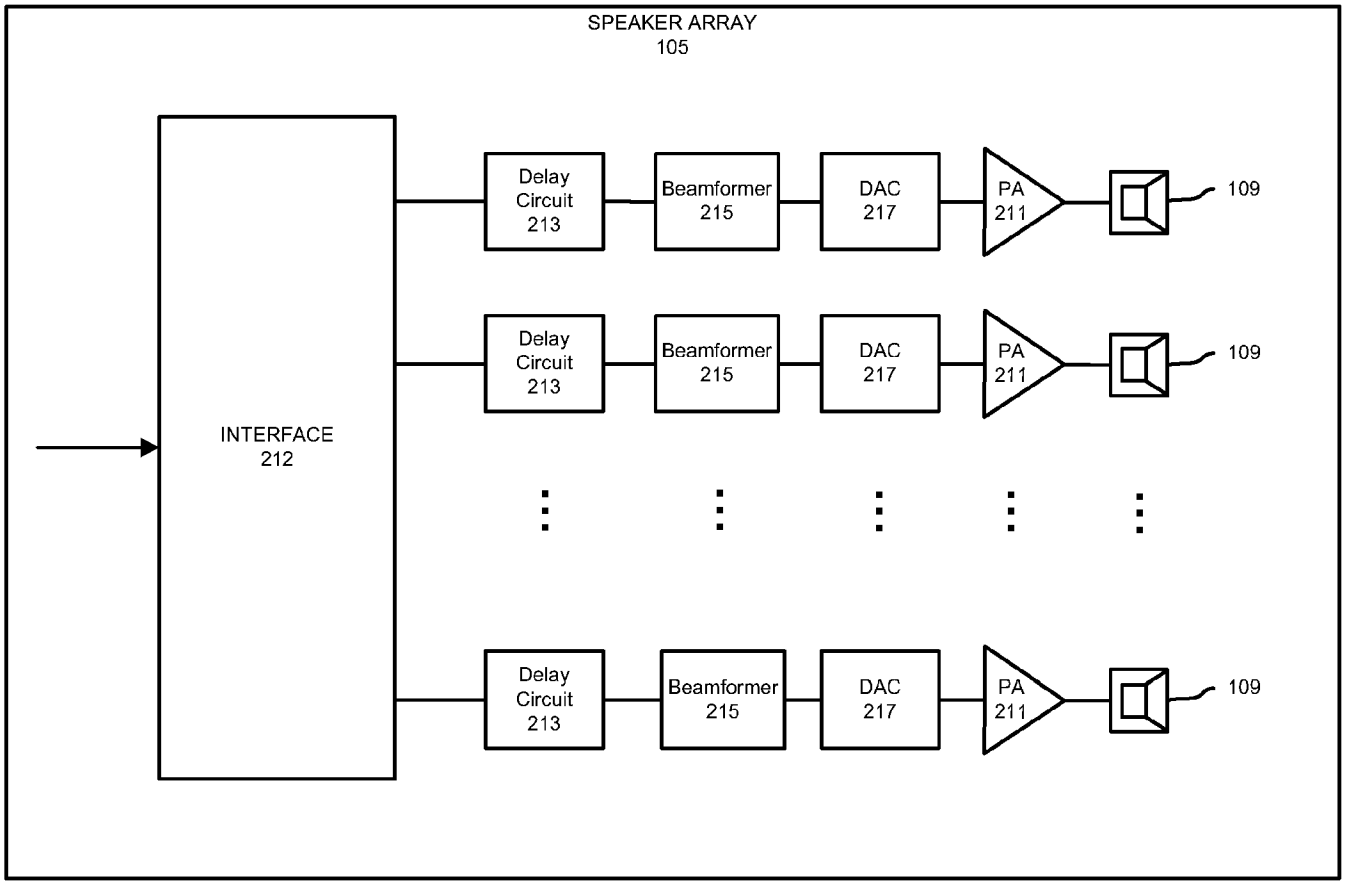
FIG. 2B shows a component diagram of a speaker array according to one embodiment.

As shown in FIG. 2B, the speaker arrays 105 may receive audio signals corresponding to audio channels from the audio source 103A through a corresponding interface 212. These audio signals may be used to drive one or more transducers 109 in the speaker arrays 105. As with the interface 207, the interface 212 may utilize wired protocols and standards and/or one or more wireless protocols and standards, including the IEEE 802.11 suite of standards, cellular Global System for Mobile Communications (GSM) standards, cellular Code Division Multiple Access (CDMA) standards, Long Term Evolution (LTE) standards, and/or Bluetooth standards. In some embodiment, the speaker arrays 105 may include digital-to-analog converters 217, power amplifiers 211, delay circuits 213, and beamformers 215 for driving transducers 109 in the speaker arrays 105.

Although described and shown as being separate from the audio source 103A, in some embodiments, one or more components of the audio source 103A may be integrated within the speaker arrays 105. For example, one or more of the speaker arrays 105 may include the hardware processor 201, the memory unit 203, and the one or more audio inputs 205.

Figure 3A:
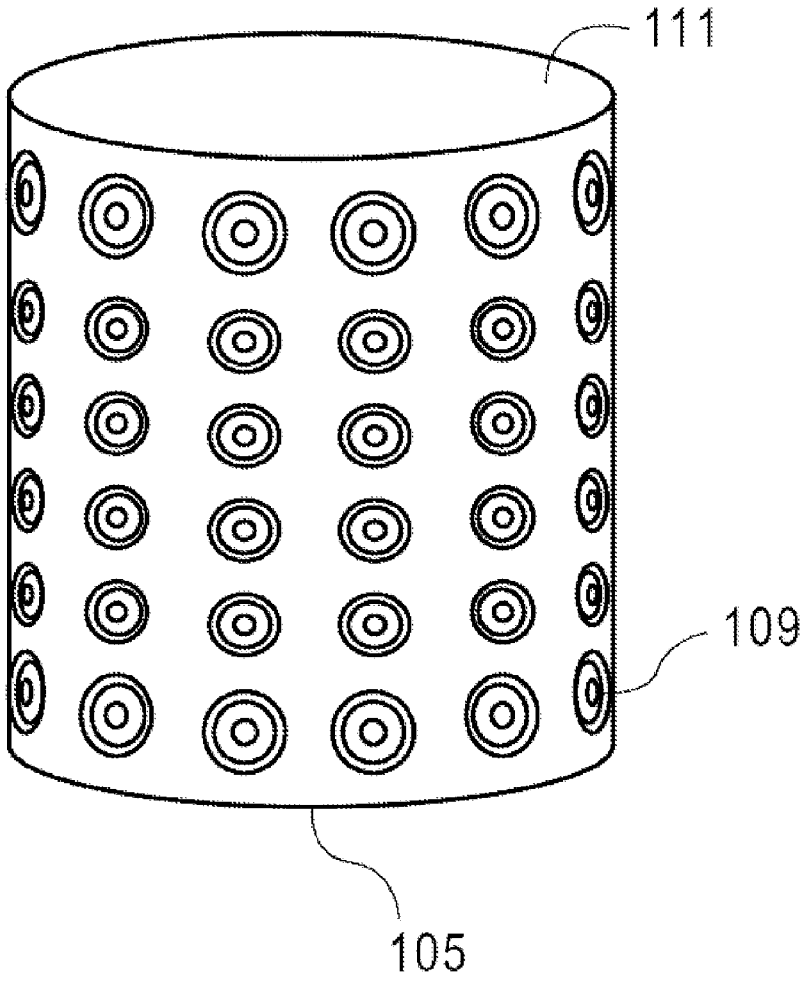
FIG. 3A shows a side view of a speaker array according to one embodiment.

FIG. 3A shows a side view of one of the speaker arrays 105 according to one embodiment. As shown in FIG. 3A, the speaker arrays 105 may house multiple transducers 109 in a curved cabinet 111. As shown, the cabinet 111 is cylindrical; however, in other embodiments the cabinet 111 may be in any shape, including a polyhedron, a frustum, a cone, a pyramid, a triangular prism, a hexagonal prism, or a sphere.

Figure 3B:
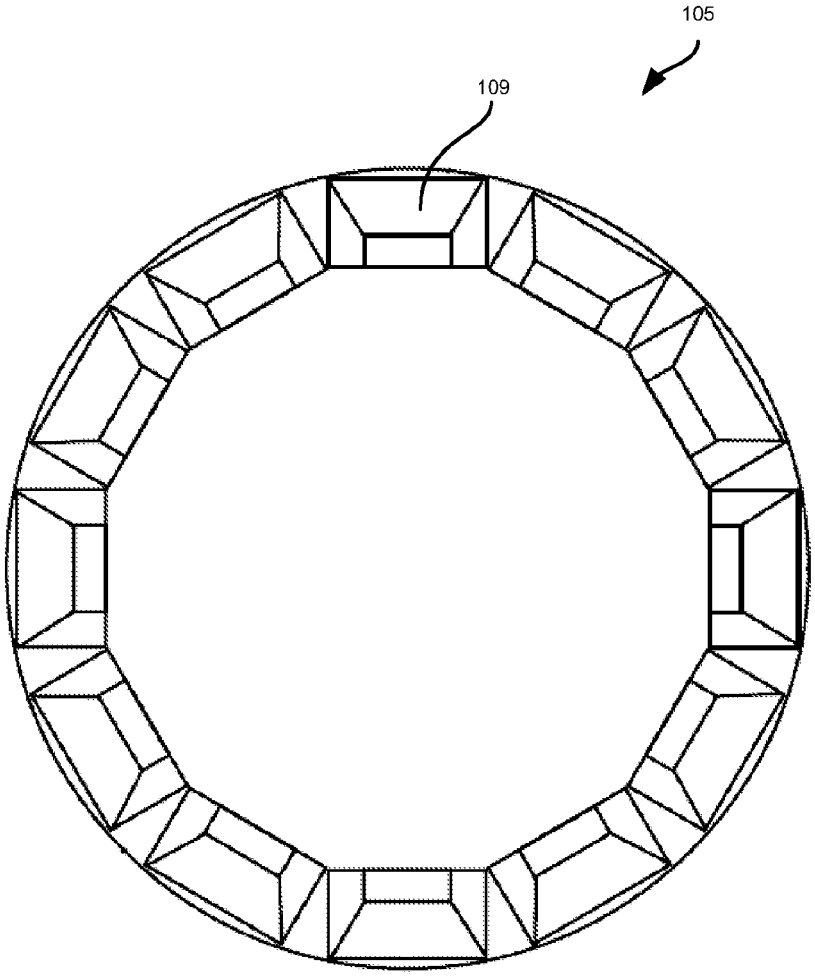
FIG. 3B shows an overhead, cutaway view of a speaker array according to one embodiment.

FIG. 3B shows an overhead, cutaway view of a speaker array 105 according to one embodiment. As shown in FIGS. 3A and 3B, the transducers 109 in the speaker array 105 encircle the cabinet 111 such that the transducers 109 cover the curved face of the cabinet 111. The transducers 109 may be any combination of full-range drivers, mid-range drivers, subwoofers, woofers, and tweeters. Each of the transducers 109 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 109 magnetic system interact, generating a mechanical force that causes the coil (and thus, the attached cone) to move back and forth, thereby reproducing sound under the control of the applied electrical audio signal coming from an audio source, such as the audio source 103A. Although electromagnetic dynamic loudspeaker drivers are described for use as the transducers 109, those skilled in the art will recognize that other types of loudspeaker drivers, such as piezoelectric, planar electromagnetic and electrostatic drivers are possible.

Figure 4:
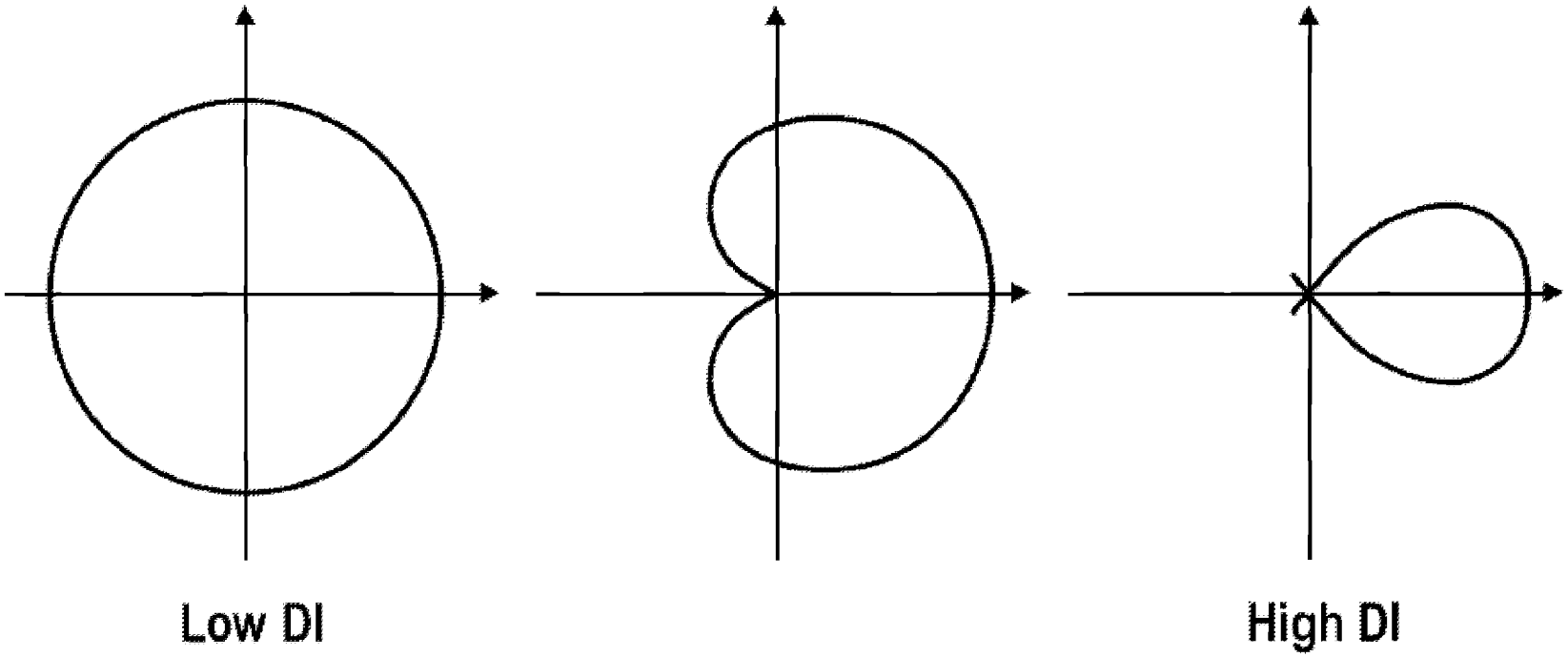
FIG. 4 shows three example beam patterns according to one embodiment.

Each transducer 109 may be individually and separately driven to produce sound in response to separate and discrete audio signals received from an audio source 103A. By allowing the transducers 109 in the speaker arrays 105 to be individually and separately driven according to different parameters and settings (including filters which control delays, amplitude variations, and phase variations across the audio frequency range), the speaker arrays 105 may produce numerous directivity/beam patterns that accurately represent each channel of a piece of sound program content output by the audio source 103. For example, in one embodiment, the speaker arrays 105 may individually or collectively produce one or more of the directivity patterns shown in FIG. 4.

Figure 5A:
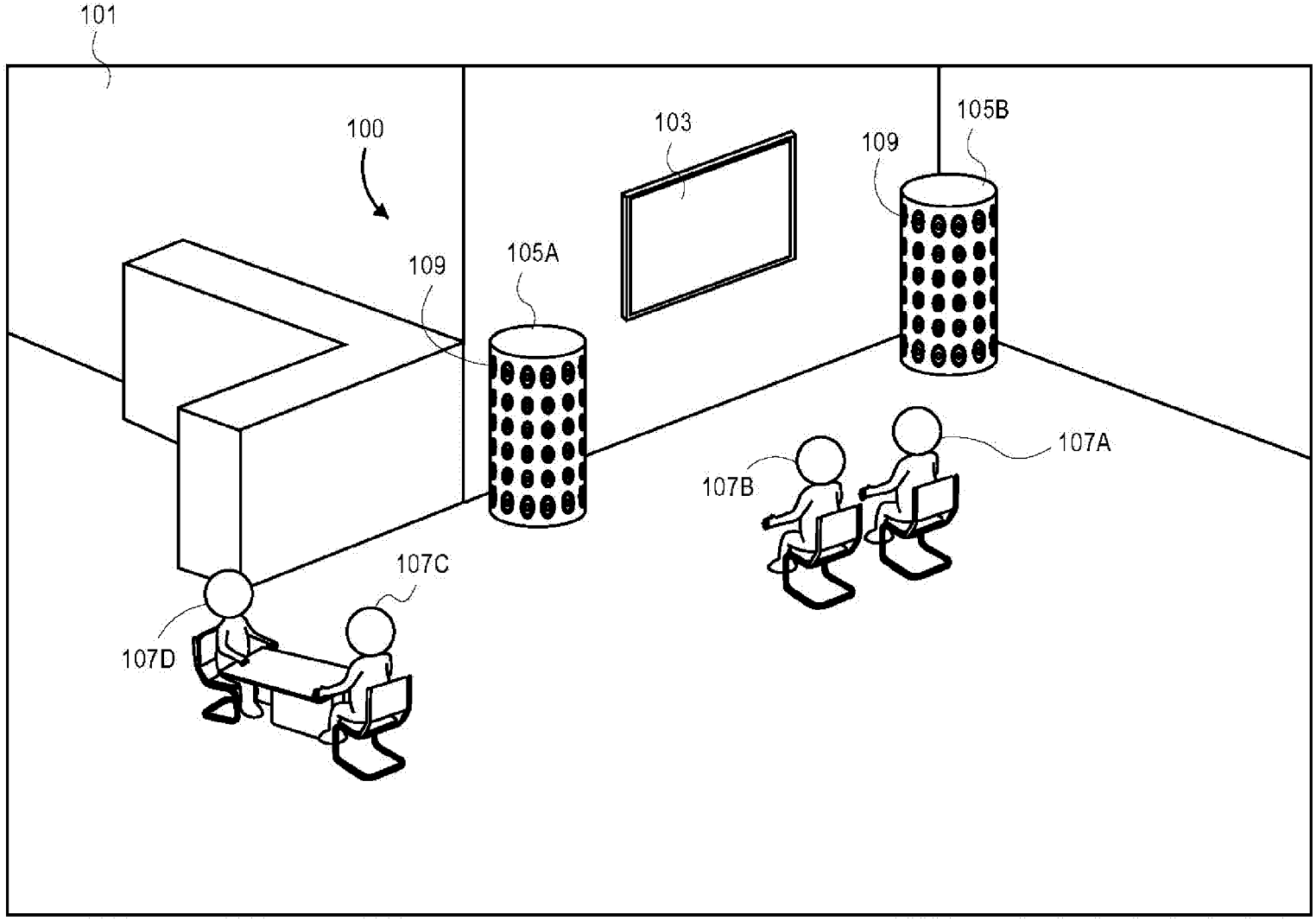
FIG. 5A shows two speaker arrays within a listening area according to one embodiment.
Figure 5B:
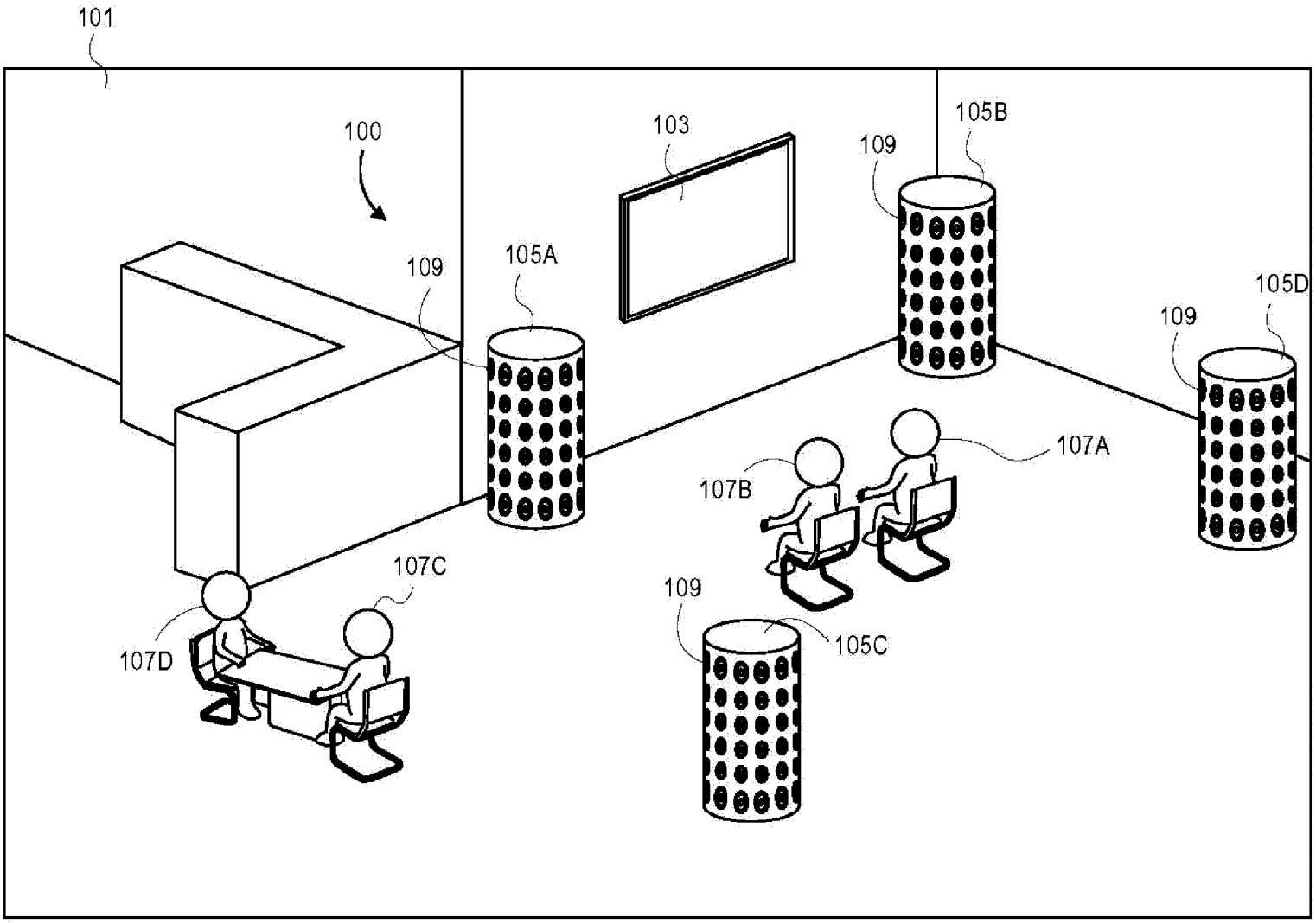
FIG. 5B shows four speaker arrays within a listening area according to one embodiment.

Although shown in FIG. 1A and FIG. 1B as including three speaker arrays 105, in other embodiments a different number of speaker arrays 105 may be used. For example, as shown in FIG. 5A two speaker arrays 105 may be used while as shown in FIG. 5B four speaker arrays 105 may be used within the listening area 101. The number, type, and positioning of speaker arrays 105 may vary over time. For example, a user 107 may move a speaker array 105 and/or add a speaker array 105 to the system 100 during playback of a movie. Further, although shown as including one audio source 103A (FIG. 1A) or two audio sources 103A and 103B (FIG. 1B), similar to the speaker arrays 105, the number, type, and positioning of audio sources 103 may vary over time.

In one embodiment, the layout of the speaker arrays 105, the audio sources 103, and the users 107 may be determined using various sensors and/or input devices as will be described in greater detail below. Based on the determined layout of the speaker arrays 105, the audio sources 103, and/or the users 107, audio beam attributes may be generated for each channel of pieces of sound program content to be played in the listening area 101. These beam attributes may be used to output audio beams into corresponding audio zones 113 as will be described in greater detail below.

Figure 6:
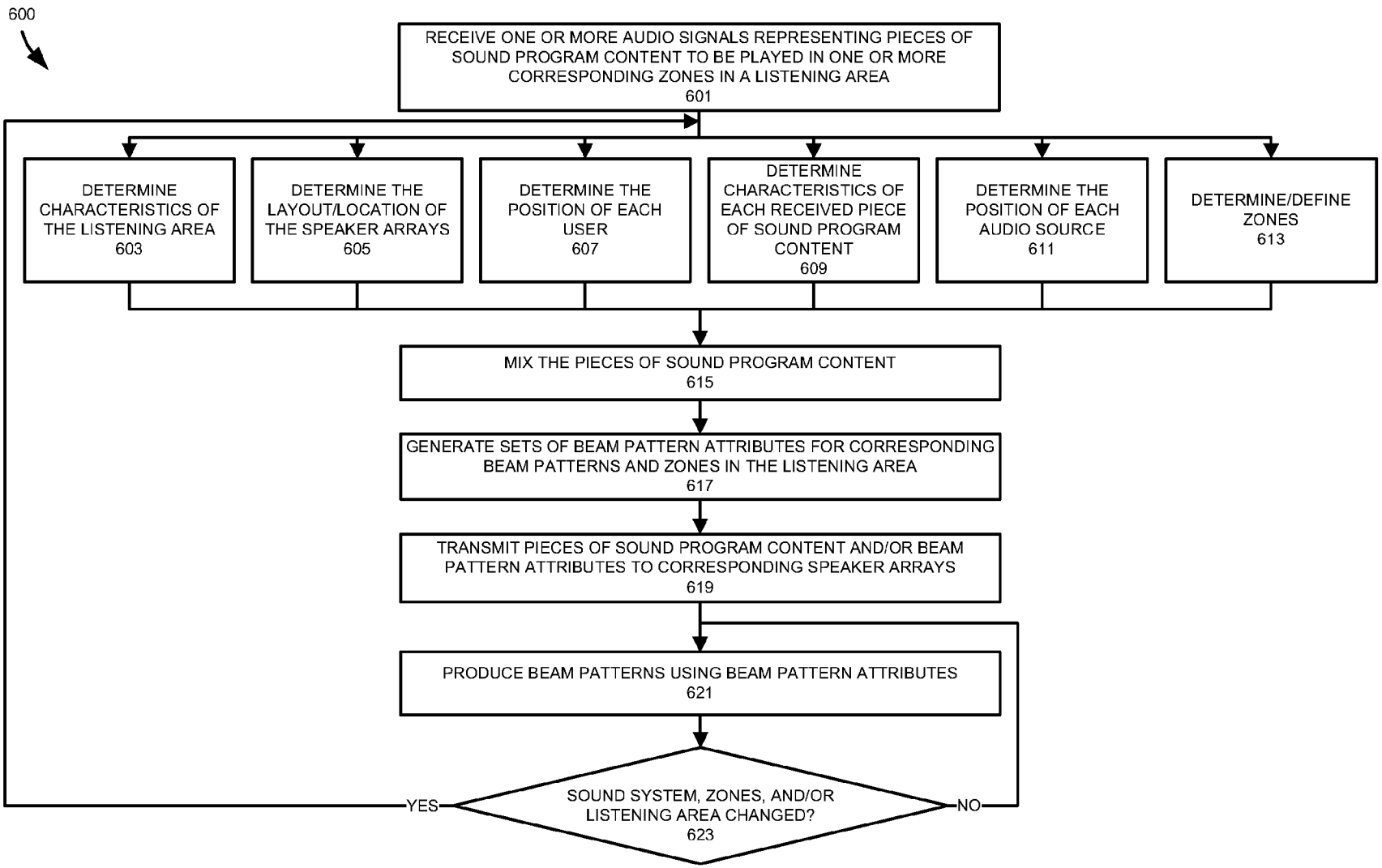
FIG. 6 shows a method for driving one or more speaker arrays to generate sound for one or more zones in the listening area based on one or more pieces of sound program content according to one embodiment.
Figure 7:
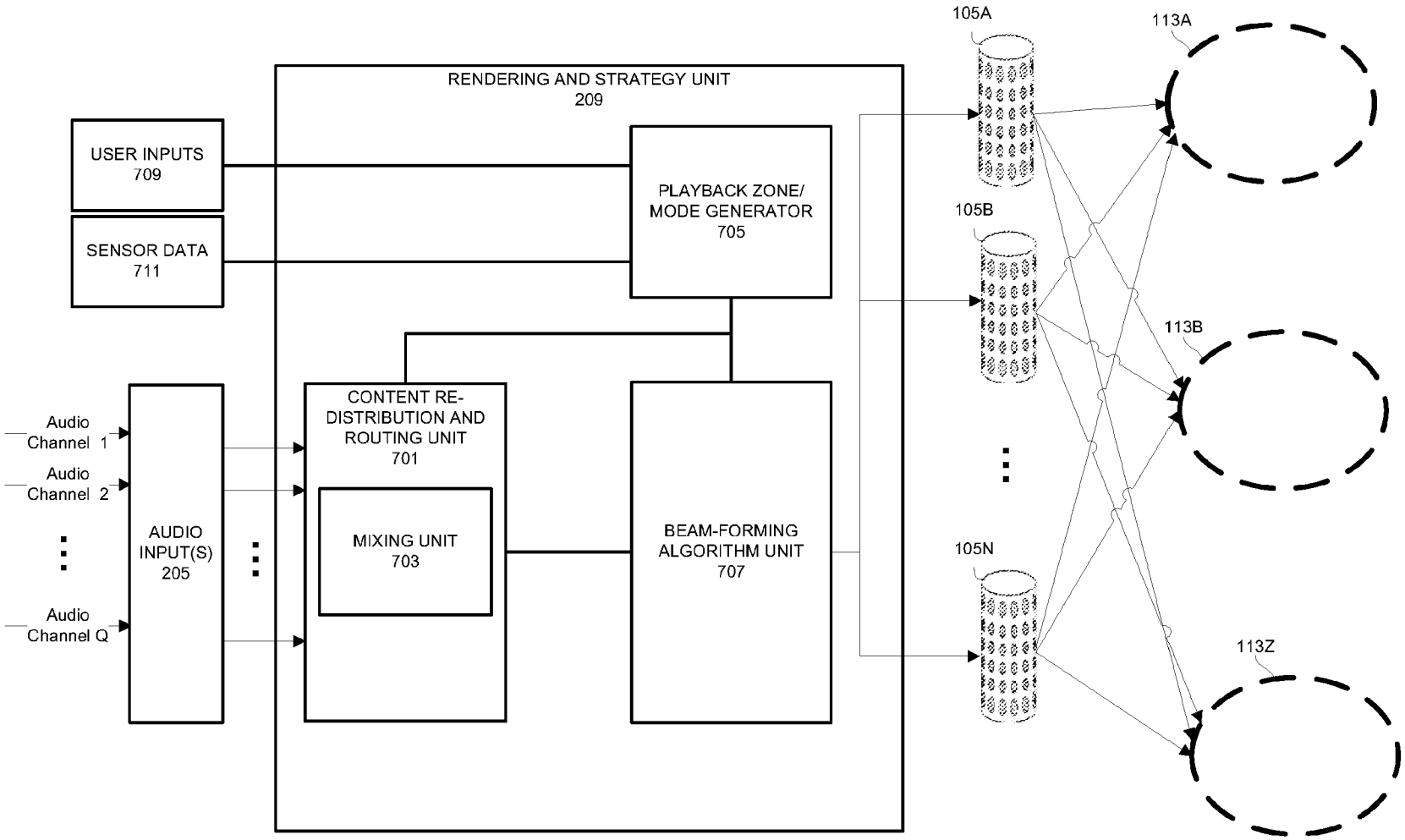
FIG. 7 shows a component diagram of a rendering strategy unit according to one embodiment.

Turning now to FIG. 6, a method 600 for driving one or more speaker arrays 105 to generate sound for one or more zones 113 in the listening area 101 based on one or more pieces of sound program content will now be discussed. Each operation of the method 600 may be performed by one or more components of the audio sources 103A/103B and/or the speaker arrays 105. For example, one or more of the operations of the method 600 may be performed by the rendering strategy unit 209 of an audio source 103. FIG. 7 shows a component diagram of the rendering strategy unit 209 according to one embodiment. Each element of the rendering strategy unit 209 shown in FIG. 7 will be described in relation to the method 600 described below.

As noted above, in one embodiment, one or more components of an audio source 103 may be integrated within one or more speaker arrays 105. For example, one of the speaker arrays 105 may be designated as a master speaker array 105. In this embodiment, the operations of the method 600 may be solely or primarily performed by this master speaker array 105 and data generated by the master speaker array 105 may be distributed to other speaker arrays 105 as will be described in greater detail below in relation to the method 600.

Although the operations of the method 600 are described and shown in a particular order, in other embodiments, the operations may be performed in a different order. In some embodiments, two or more operations may be performed concurrently or during overlapping time periods.

In one embodiment, the method 600 may begin at operation 601 with receipt of one or more audio signals representing pieces of sound program content. In one embodiment, the one or more pieces of sound program content may be received by one or more of the speaker arrays 105 (e.g., a master speaker array 105) and/or an audio source 103 at operation 601. For example, signals corresponding to the pieces of sound program content may be received by one or more of the audio inputs 205 and/or the content re-distribution and routing unit 701 at operation 601. The pieces of sound program content may be received at operation 601 from various sources, including streaming internet services, set-top boxes, local or remote computers, personal audio and video devices, etc. Although described as the audio signals being received from a remote or external source, in some embodiments the signals may originate or may be generated by an audio source 103 and/or a speaker array 105.

As noted above, each of the audio signals may represent a piece of sound program content (e.g., a musical composition or an audio track for a movie) that is to be played to the users 107 in respective zones 113 of the listening area 101 through the speaker arrays 105. In one embodiment, each of the pieces of sounds program content may include one or more audio channels. For example, a piece of sound program content may include five channels of audio, including a front left channel, a front center channel, a front right channel, a left surround channel, and a right surround channel. In other embodiments, 5.1, 7.1, or 9.1 multichannel audio streams may be used. Each of these channels of audio may be represented by corresponding signals or through a single signal received at operation 601.

Upon receipt of one or more signals representing one or more pieces of sound program content at operation 601, the method 600 may determine one or more parameters that describe 1) characteristics of the listening area 101; 2) the layout/location of the speaker arrays 105; 3) the location of the users 107; 4) characteristics of the pieces of sound program content; 5) the layout of the audio sources 103; and/or 6) characteristics of each audio zone 113. For example, at operation 603 the method 600 may determine characteristics of the listening area 101. These characteristics may include the size and geometry of the listening area 101 (e.g., the position of walls, floors, and ceilings in the listening area 101) and/or reverberation characteristics of the listening area 101, and/or the positions of objects within the listening area 101 (e.g., the position of couches, tables, etc.). In one embodiment, these characteristics may be determined through the use of the user inputs 709 (e.g., a mouse, a keyboard, a touch screen, or any other input device) and/or sensor data 711 (e.g., still image or video camera data and an audio beacon data). For example, images from a camera may be utilized to determine the size of and obstacles in the area 101, data from an audio beacon that utilizes audible or inaudible test sounds may indicate reverberation characteristics of the listening area 101, and/or the user 107 may utilize an input device 709 to manually indicate the size and layout of the listening area 101. The input devices 709 and sensors that produce the sensor data 711 may be integrated with an audio source 103 and/or a speaker array 105 or part of an external device (e.g., a mobile device in communication with an audio source 103 and/or a speaker array 105).

In one embodiment, the method 600 may determine the layout and positioning of the speaker arrays 105 in the listening area 101 and/or in each zone 113 at operation 605. In one embodiment, similar to operation 603, operation 605 may be performed through the use of the user inputs 709 and/or sensor data 711. For example, test sounds may be sequentially or simultaneously emitted by each of the speaker arrays 105 and sensed by a corresponding set of microphones. Based on these sensed sounds, operation 605 may determine the layout and positioning of each of the speaker arrays 105 in the listening area 101 and in the zones 113. In another example, the user 107 may assist in determining the layout and positioning of speaker arrays 105 in the listening area 101 and in the zones 113 through the use of the user inputs 709. In this example, the user 107 may manually indicate the locations of the speaker arrays 105 using a photo or video stream of the listening area 101. This layout and positioning of the speaker arrays 105 may include the distance between speaker arrays 105, the distance between speaker arrays 105 and one or more users 107, the distance between the speaker arrays 105 and one or more audio sources 103, and/or the distance between the speaker arrays 105 and one or more objects in the listening area 101 or the zones 113 (e.g., walls, couches, etc.).

In one embodiment, the method 600 may determine the position of each user 107 in the listening area 101 and in each zone 113 at operation 607. In one embodiment, similar to operations 603 and 605, operation 607 may be performed through the use of the user inputs 709 and/or sensor data 711. For example, captured images/videos of the listening area 101 and the zones 113 may be analyzed to determine the positioning of each user 107 in the listening area 101 and in each zone 113. The analysis may include the use of facial recognition to detect and determine the positioning of the users 107. In other embodiments, microphones may be used to detect the locations of users 107 in the listening area 101 and/or in the zones 113. The positioning of users 107 may be relative to one or more speaker arrays 105, one or more audio sources 103, and/or one or more objects in the listening area 101 or the zones 113. In some embodiments, other types of sensors may be used to detect the location of users 107, including global positioning sensors, motion detection sensors, microphones, etc.

In one embodiment, the method 600 may determine characteristics regarding the one or more received pieces of sound program content at operation 609. In one embodiment, the characteristics may include the number of channels in each piece of sound program content, the frequency range of each piece of sound program content, and/or the content type of each piece of sound program content (e.g., music, dialogue, or sound effects). As will be described in greater detail below, this information may be used to determine the number or type of speaker arrays 105 necessary to reproduce the pieces of sound program content.

In one embodiment, the method 600 may determine the positions of each audio source 103 in the listening area 101 and in each zone 113 at operation 611. In one embodiment, similar to operations 603, 605, and 607, operation 611 may be performed through the use of the user inputs 709 and sensor data 711. For example, captured images/videos of the listening area 101 and the zones 113 may be analyzed to determine the positioning of each of the audio sources 103 in the listening area 101 and/or in each zone 113. The analysis may include the use of pattern recognition to detect and determine the positioning of the audio sources 103. The positioning of the audio sources 103 may be relative to one or more speaker arrays 105, one or more users 107, and one or more objects in the listening area 101 or the zones 113.

At operation 613, the method 600 may determine/define zones 113 within the listening area 101. The zones 113 represent segments of the listening area 101 that are associated with corresponding pieces of sound program content. For example, a first piece of sound program content may be associated with the zone 113A as described above and shown in FIG. 1A and FIG. 1B while a second piece of sound program content may be associated with the zone 113B. In this example, the first piece of sound program content is designated to be played in the zone 113A while the second piece of sound program content is designated to be played in the zones 113B. Although shown as circular, zones 113 may be defined by any shape and may be any size. In some embodiments, the zones 113 may be overlapping and/or may encompass the entire listening area 101.

In one embodiment, the determination/definition of zones 113 in the listening area 101 may be automatically configured based on the determined locations of users 107, the determined locations of audio sources 103, and/or the determined locations of speaker arrays 105. For example, upon determining that the users 107A and 107B are located proximate to the audio source 103A (e.g., a television) while the users 107C and 107D are located proximate to the audio source 103B (e.g., a radio), operation 613 may define a first zone 113A around the users 107 A and 107B and a second zone 113B around the users 107C and 107D. In other embodiments, the user 107 may manually define zones using the user inputs 709. For example, a user 107 may utilize a keyboard, mouse, touch screen, or another input device to indicate the parameters of one or more zones 113 in the listening area 101. In one embodiment, the definition of zones 113 may include a size, shape, and a position relative to another zone and/or another object (e.g., a user 107, an audio source 103, a speaker array 105, a wall in the listening area 101, etc.) This definition may also include the association of pieces of sound program content with each zone 113.

As shown in FIG. 6, each of the operations 603, 605, 607, 609, 611, and 613 may be performed concurrently. However, in other embodiments, one or more of the operations 603, 605, 607, 609, 611, and 613 may be performed consecutively or in an otherwise non-overlapping fashion. In one embodiment, one or more of the operations 603, 605, 607, 609, 611, and 613 may be performed by the playback zone/mode generator 705 of the rendering and strategy unit 209.

Following retrieval of one or more parameters that describe 1) characteristics of the listening area 101; 2) the layout/location of the speaker arrays 105; 3) the location of the users 107; 4) characteristics of the audio streams; 5) the layout of the audio sources 103; and 6) characteristics of each audio zone 113, the method 600 may move to operation 615. At operation 615, pieces of sound program content received at operation 601 may be remixed to produce one or more audio channels for each piece of sound program content. As noted above, each piece of sound program content received at operation 601 may include multiple audio channels. At operation 615, audio channels may be extracted for these pieces of sound program content based on the capabilities and requirements of the audio system 100 (e.g., the number, type, and positioning of the speaker arrays 105). In one embodiment, the remixing at operation 615 may be performed by the mixing unit 703 of the content redistribution and routing unit 701.

In one embodiment, the optional mixing of each piece of sound program content at operation 615 may take into account the parameters/characteristics derived through operations 603, 605, 607, 609, 611, and 613. For example, operation 615 may determine that there are an insufficient number of speaker arrays 105 to represent ambience or surround audio channels for a piece of sound program content. Accordingly, operation 615 may mix the one or more pieces of sound program content received at operation 601 without ambience and/or surround channels. Conversely, upon determining that there are a sufficient number of speaker arrays 105 to produce ambience or surround audio channels based on parameters derived through operations 603, 605, 607, 609, 611, and 613, operation 615 may extract ambience and/or surround channels from the one or more pieces of sound program content received at operation 601.

Figure 8:
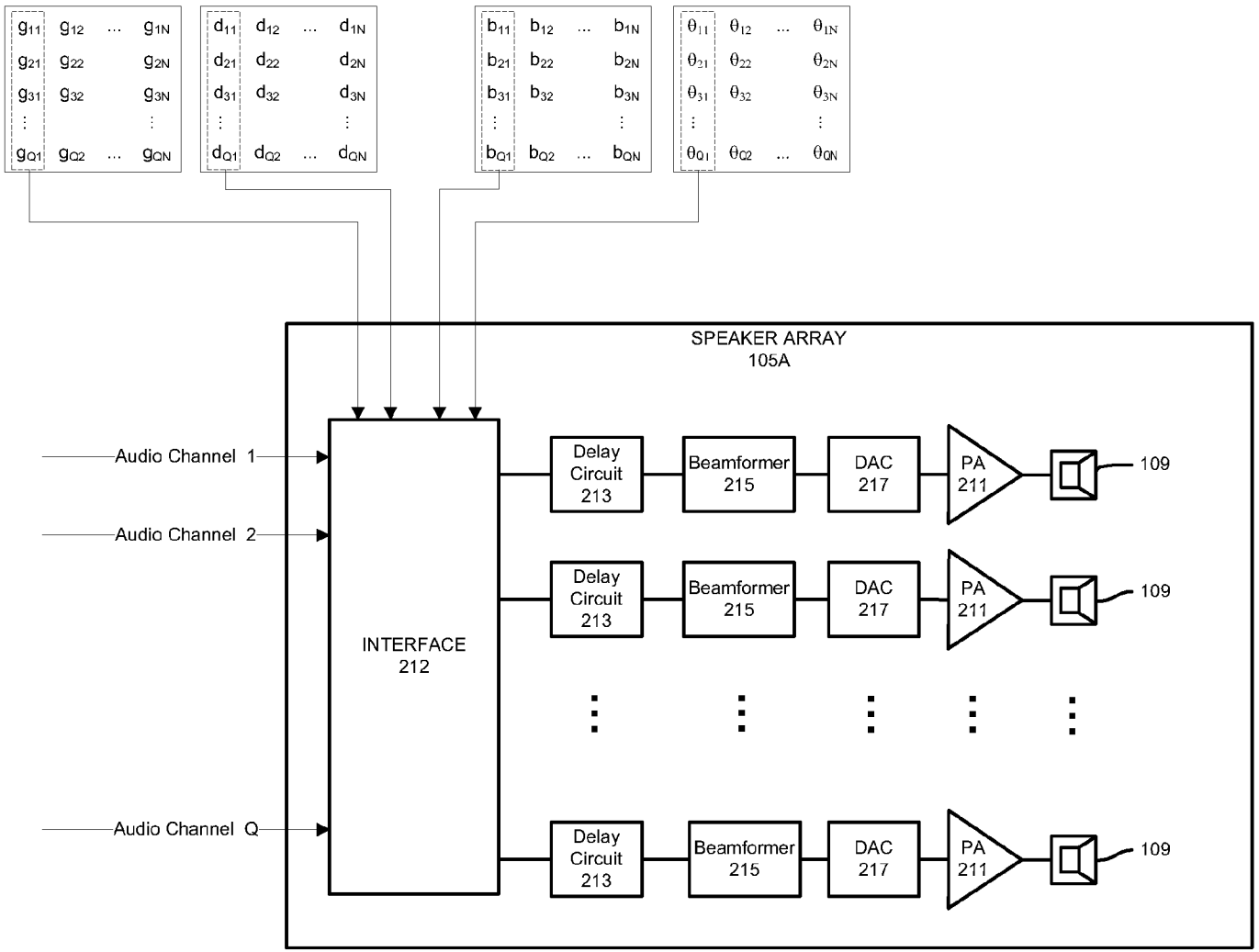
FIG. 8 shows beam attributes used to generate beams in separate zones of the listening area according to one embodiment.

Following optional mixing of the received pieces of sound program content at operation 615, operation 617 may generate a set of audio beam attributes corresponding to each channel of the pieces of the sound program content that will be output into each corresponding zone 113. In one embodiment, the attributes may include gain values, delay values, beam type pattern values (e.g., cardioid, omnidirectional, and figure-eight beam type patterns), and/or beam angle values (e.g., 0°-180°). Each set of beam attributes may be used to generate corresponding beam patterns for channels of the one or more pieces of sound program content. For example, as shown in FIG. 8, the beam attributes correspond to each of Q audio channels for one or more pieces of sound program content and N speaker arrays 105. Accordingly, Q×N matrices of gain values, delays values, beam type pattern values, and beam angle values are generated. These beam attributes allow the speaker arrays 105 to generate audio beams for corresponding pieces of sound program content that are focused in associated zones 113 within the listening area 101. As will be described in further detail below, as a change occurs within the listening environment (e.g., the audio system 100, the listening area 101, and/or the zones 113), the beam attributes may be adjusted to cope with these changes. In one embodiment, the beam attributes may be generated at operation 617 using the beam forming algorithm unit 707.

Figure 9A:
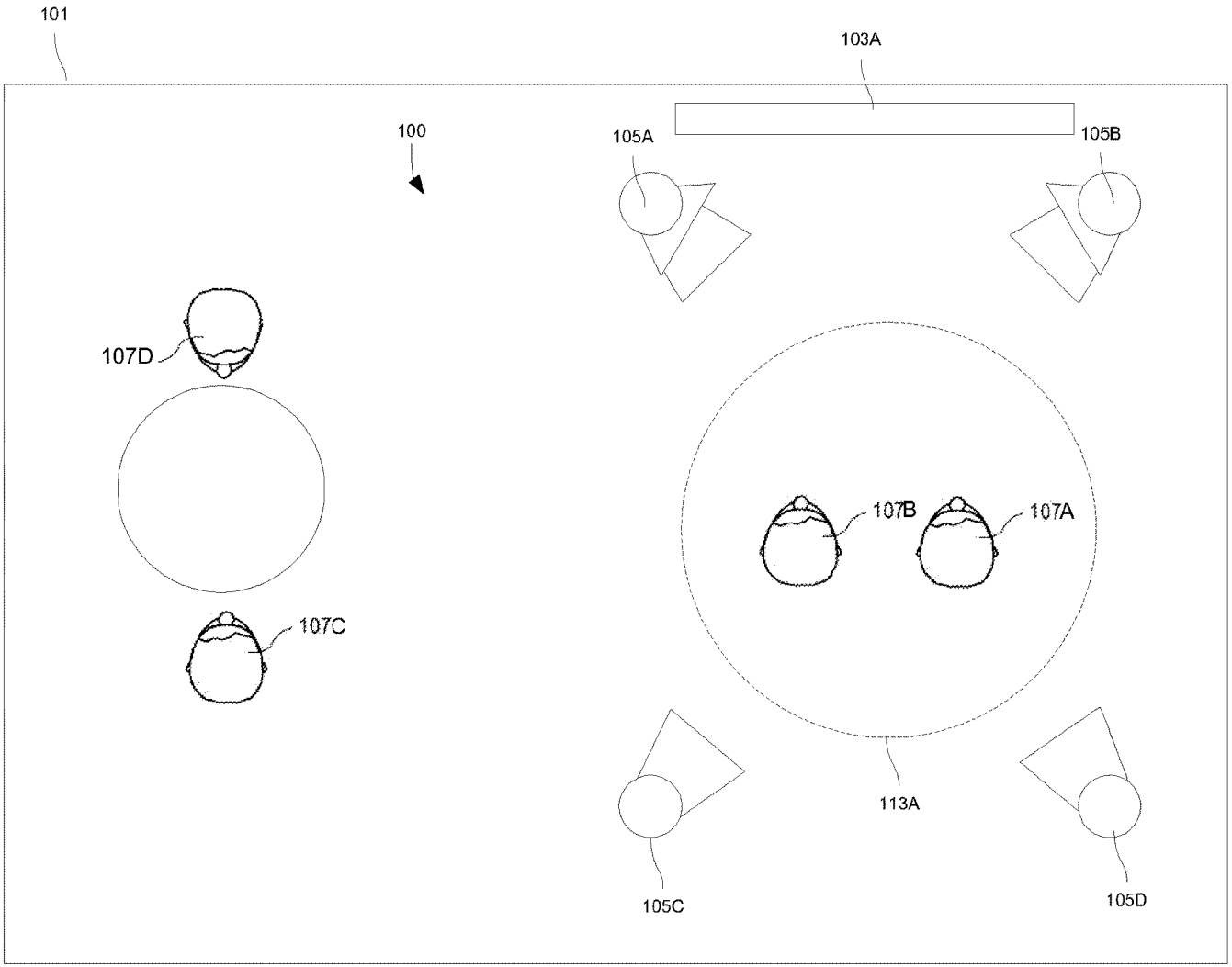
FIG. 9A shows an overhead view of the listening area with beams produced for a single zone according to one embodiment.

FIG. 9A shows an example audio system 100 according to one embodiment. In this example, the speaker arrays 105A-105D may output sound corresponding to a five channel piece of sound program content into the zone 113A. In particular, the speaker array 105A outputs a front left beam and a front left center beam, the speaker array 105B outputs a front right beam and a front right center beam, the speaker array 105C outputs a left surround beam, and the speaker array 105D outputs a right surround beam. The front left center and the front right center beams may collectively represent a front center channel while the other four beams produced by the speaker arrays 105A-105D represent corresponding audio channels for a five channel piece of sound program content. For each of these six beams generated by the speaker arrays 105A-105D, operation 615 may generate a set of beam attributes based on one or more of the factors described above. The sets of beam attributes produce corresponding beams based on the changing conditions of the listening environment.

Figure 9B:
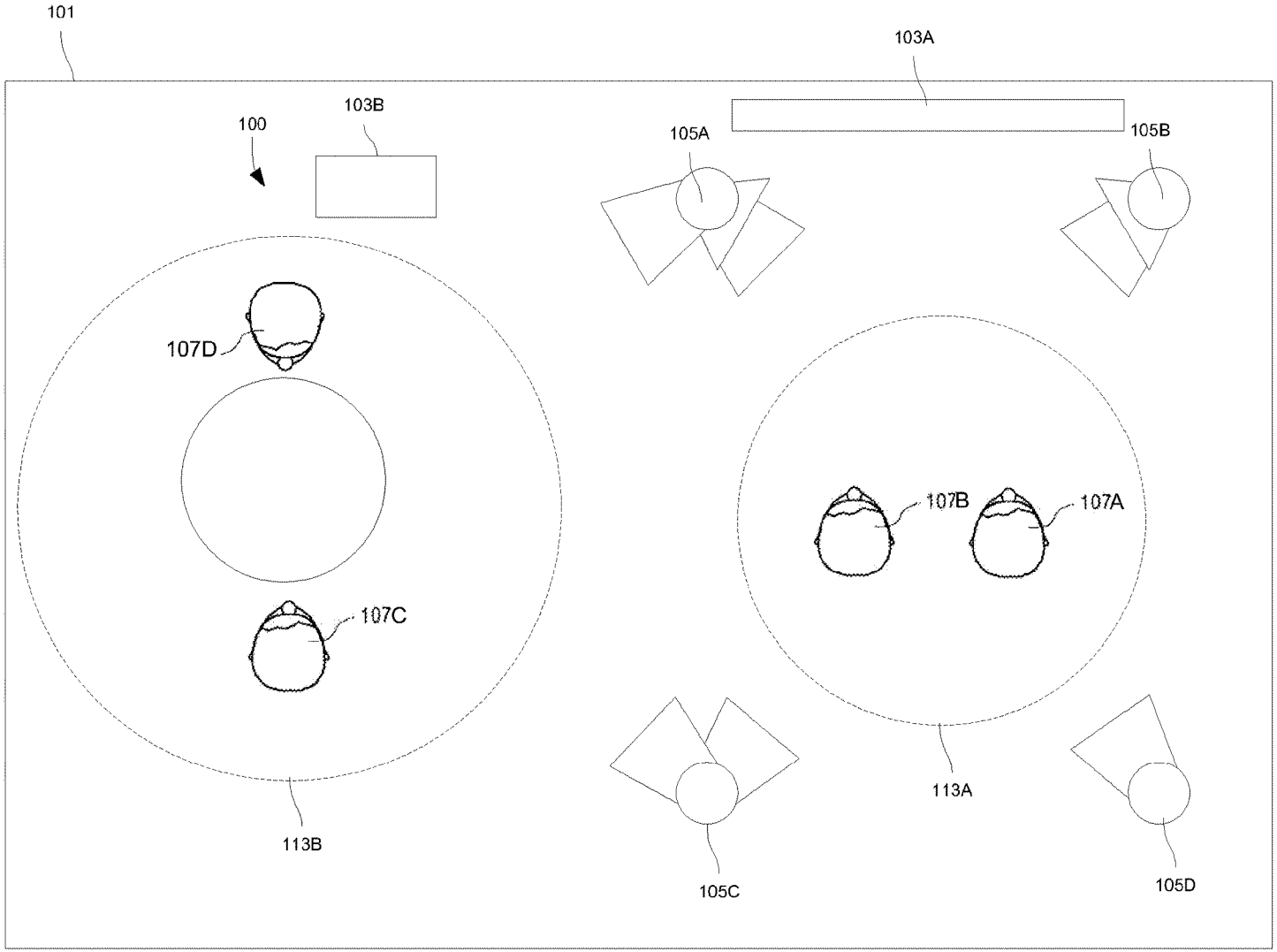
FIG. 9B shows an overhead view of the listening area with beams produced for two zones according to one embodiment.

Although FIG. 9A corresponds to a single piece of sound program content played in a single zone (e.g., zone 113A), as shown in FIG. 9B the speaker arrays 105A-105D may simultaneously produce audio beams for another piece of sound program content to be played in another zone (e.g., the zone 113B). As shown in FIG. 9B, the speaker arrays 105A-105D produce six beams patterns to represent the five channel piece of sound program content described above in the zone 113A while the speaker arrays 105A and 105C may produce an additional two beam patterns to represent a second piece of sound program content with two channels in the zone 113B. In this example, operation 615 may produce beam attributes corresponding to the seven channels being played through the speaker arrays 105A-105D (i.e., five channels for the first piece of sound program content and two channels for the second piece of sound program content). The sets of beam attributes produce corresponding beams based on the changing conditions of the listening environment.

In each case, the beam attributes may be relative to each corresponding zone 113, set of users 107 within the zone 113, and a corresponding piece of sound program content.

For example, the beam attributes for the first piece of sound program content described above in relation to FIG. 9A may be generated in relation to the characteristics of the zone 113A, the positioning of the speaker arrays 105 relative to the users 107A and 107B, and the characteristics of the first piece of sound program content. In contrast, the beam attributes for the second piece of sound program content may be relative to the characteristics of the zone 113B, the positioning of the speaker arrays 105 relative to the users 107C and 107D, and the characteristics of the second piece of sound program content. Accordingly, each of the first and second pieces of sound program content may be played in each corresponding audio zone 113A and 113B relative to the conditions of each respective zone 113A and 113B.

Following operation 617, operation 619 may transmit each of the sets of beam attributes to corresponding speaker arrays 105. For example, the speaker array 105A in FIG. 9B may receive three sets of beam pattern attributes corresponding to each front left beam and front left center beam for the first piece of sound program content and beam pattern attributes for the second piece of sound program content. The speaker arrays 105 may use these beam attributes to continually output sound for each piece of sound program content received at operation 601 in each corresponding zone 113.

In one embodiment, each piece of sound program content may be transmitted to corresponding speaker arrays 105 along with associated sets of beam pattern attributes. In other embodiments, these pieces of sound program content may be transmitted separately from the sets of beam pattern attributes to each speaker array 105.

Upon receipt of the pieces of sound program content and corresponding sets of beam pattern attributes, the speaker arrays 105 may drive each of the transducers 109 to generate corresponding beam patterns in corresponding zones 113 at operation 621. For example, as shown in FIG. 9B, the speaker arrays 105A-105D may produce beam patterns in the zones 113A and 113B for two pieces of sound program content. As described above, each speaker array 105 may include corresponding digital-to-analog converters 217, power amplifiers 211, delay circuits 213, and beamformers 215 for driving transducers 109 to produce beam patterns based on these beam pattern attributes and pieces of sound program content.

At operation 623, the method 600 may determine if anything in the sound system 100, the listening area 101, and/or in the zones 113 has changed from the performance of operation 603, 605, 607, 609, 611, and 613. For example, changes may include the movement of a speaker array 105, the movement of a user 107, the change in a piece of sound program content, the movement of another object in the listening area 101 and/or in a zone 113, the movement of an audio source 103, the redefinition of a zone 113, etc. Changes may be determined at operation 623 through the use of the user inputs 709 and sensor data 711. For example, images of the listening area 101 and the zones 113 may be continually examined to determine if changes have occurred. Upon determination of a change in the listening area 101 and the zones 113, the method 600 may return to operations 603, 605, 607, 609, 611, and 613 to determine one or more parameters that describe 1) characteristics of the listening area 101; 2) the layout/location of the speaker arrays 105; 3) the location of the users 107; 4) characteristics of the pieces of sound program content; 5) the layout of the audio sources 103; and/or 6) characteristics of each audio zone 113. Using these pieces of data, new beam pattern attributes may be constructed using similar techniques described above. Conversely, if no changes are detected at operation 623, the method 600 may continue to output beam patterns based on the previously generated beam pattern attributes at operation 621.

Although described as detecting changes in the listening environment at operation 623, in some embodiments operation 623 may determine whether another triggering event has occurred. For example, other triggering events may include the expiration of a time period, the initial configuration of the audio system 100, etc. Upon detection of one or more of these triggering events, operation 623 may direct the method 600 to move to operations 603, 605, 607, 609, 611, and 613 to determine parameters of the listening environment as described above.

As described above, the method 600 may produce beam pattern attributes based on the position/layout of speaker arrays 105, the positioning of users 107, the characteristics of the listening area 101, the characteristics of pieces of sound program content, and/or any other parameter of the listening environment. These beam pattern attributes may be used for driving the speaker arrays 105 to produce beams representing channels of one or more pieces of sound program content in separate zones 113 of the listening area. As changes occur in the listening area 101 and/or the zones 113, the beam pattern attributes may be updated to reflect the changed environment. Accordingly, sound produced by the audio system 100 may continually account for the variable conditions of the listening area 101 and the zones 113. By adapting to these changing conditions, the audio system 100 is capable of reproducing sound that accurately represents each piece of sound program content in various zones 113.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method of driving speaker arrays, comprising:

receiving a first sound program content and a second sound program content associated with respective audio sources within an audio system, wherein the first sound program content is designated to be played in a first zone within a listening area and the second program content is designated to be played in a second zone within the listening area;

determining a layout of a first speaker array and a second speaker array, wherein the first speaker array and the second speaker array have respective speaker cabinets and are movable relative to each other within the listening area;

generating one or more sets of audio beam pattern attributes based on the determined layout; and driving the first speaker array and the second speaker array with the one or more sets of audio beam pattern attributes such that each speaker array directs respective audio beams corresponding to one or more channels of the first sound program content and the second program content to the first zone and the second zone in the listening area.

2. The method of claim 1, wherein each set of the audio beam pattern attributes in the one or more sets of audio beam pattern attributes includes one or more of gain values, delay values, beam type pattern values, or beam angle values that are used to generate corresponding audio beams for each channel of the first sound program content and the second sound program content.

3. The method of claim 1 further comprising, determining one or more parameters describing the audio system, wherein the one or more parameters describing the audio system include 1) a location of each of the speaker arrays relative to each zone and 2) a location of each audio source relative to corresponding zones, and wherein the one or more sets of audio beam pattern attributes are based on the one or more parameters describing the audio system.

4. The method of claim 1 further comprising:

determining parameters for the first sound program content and the second sound program content, wherein the one or more sets of audio beam pattern attributes are generated based on the parameters for the first sound program content and the second sound program content, wherein the parameters for the first sound program content and the second sound program content include one or more of the number of channels in each of the first sound program content add the second sound program content, a frequency range of each of the first sound program content and the second sound program content, or a content type of each of the first sound program content and the second sound program content.

5. The method of claim 1 further comprising:

determining parameters for the listening area, wherein the one or more sets of audio beam pattern attributes are generated based on the parameters for the listening area, wherein the parameters for the listening area include one or more of 1) a size and a geometry of the listening area; 2) reverberation characteristics of the listening area; or 3) a location of users in the listening area.

6. The method of claim 5 further comprising:

defining each of the first zone and the second zone in the listening area, wherein the definition of each zone includes one or more of a location of the zone in the listening area, a size of the zone, shape of the zone, or a piece of sound program content from the respective sound program content designated to be played in the respective zone.

7. The method of claim 6, wherein each of the first zone and the second zone is defined based on one or more of 1) a location of one or more of the users in the listening area or 2) a location of one or more of the audio sources in the listening area.

8. The method of claim 1 further comprising:

detecting a change to the zones or the audio system;

determining, in response to detecting the change to the zones or the audio system, parameters describing the zones and the audio system;

generating one or more new sets of audio beam pattern attributes based on the determined parameters for the zones and the audio system; and driving the first speaker array and the second speaker array with the one or more new sets of audio beam pattern attributes such that each speaker array directs respective audio beams corresponding to one or more channels of the first sound program content and the second program content to the first zone and the second zone in the listening area.

9. A computing device for driving speaker arrays, comprising:

an interface for receiving a first sound program content and a second sound program content associated with respective audio sources within an audio system, wherein the first sound program content is designated to be played by the audio system in a first zone within a listening area and the second program content is designated to be played in a second zone within the listening area;

a hardware processor; and a memory unit for storing instructions, which when executed by the hardware processor:

determine a layout of a first speaker array and a second speaker array, wherein the first speaker array and the second speaker array have respective speaker cabinets and are moveable relative to each other within the listening area;

generate one or more sets of audio beam pattern attributes based on the determined layout; and generate one or more drive signals for driving the first speaker array and the second speaker array with the one or more sets of audio beam pattern attributes such that each speaker array directs respective audio beams corresponding to one or more channels of the first sound program content and the second program content to the first zone and the second zone in the listening area.

10. The computing device of claim 9, wherein each set of the audio beam pattern attributes in the one or more sets of audio beam pattern attributes includes one or more of gain values, delay values, beam type pattern values, or beam angle values that are used to generate corresponding audio beams for each channel of the first sound program content and the second sound program content.

11. The computing device of claim 9 further comprising:

determining one or more parameters describing the audio system, wherein the one or more parameters describing the audio system include 1) a location of each of the speaker arrays relative to each zone and 2) a location of each audio source relative to corresponding zone, and wherein the one or more sets of audio beam pattern attributes are based on the one or more parameters describing the audio system.

12. The computing device of claim 9, wherein the memory unit includes further instructions which when executed by the hardware processor:

determine parameters for the first sound program content and the second sound program content, wherein the one or more sets of audio beam pattern attributes are generated based on the parameters for the first sound program content and the second sound program content, wherein the parameters for the first sound program content and the second sound program content include one or more of a number of channels in each of the first sound program content and the second sound program content, a frequency range of each of the first sound program content and the second sound program content, or a content type of each of the first sound program content and the second sound program content.

13. The computing device of claim 9, wherein the memory unit includes further instructions which when executed by the hardware processor:

determine parameters for the listening area, wherein the one or more sets of audio beam pattern attributes are generated based on the parameters for the listening area, wherein the parameters for the listening area include one or more of 1) a size and a geometry of the listening area; 2) reverberation characteristics of the listening area; or 3) a location of users in the listening area.

14. The computing device of claim 13, wherein the memory unit includes further instructions which when executed by the hardware processor:

define each of the first zone and the second zone in the listening area, wherein the definition of each zone includes one or more of a location of the zone in the listening area, a size of the zone, a shape of the zone, or a piece of sound program content from the respective sound program content designated to be played in the respective zone.

15. The computing device of claim 14, wherein each of the first zone and the second zone is defined based on one or more of 1) a location of one or more of the users in the listening area or 2) a location of one or more of the audio sources in the listening area.

16. The computing device of claim 9, wherein the memory unit includes further instructions which when executed by the hardware processor:

detect a change to the zones or the audio system;

determine, in response to detecting the change to the zones or the audio system, parameters describing the zones and the audio system;

generate one or more new sets of audio beam pattern attributes based on the determined parameters for the zones and the audio system; and generate one or more drive signals for driving the first speaker array and the second speaker array with the one or more new sets of audio beam pattern attributes such that each speaker array directs respective audio beams corresponding to one or more channels of the first sound program content and the second program content to the first zone and the second zone in the listening area.

17. An article of manufacture for driving speaker arrays to play one or more pieces of sound program content associated with one or more audio sources within an audio system, wherein each piece of sound program content is designated to be played by the audio system in one zone of a plurality of zones within a listening area, the article of manufacture comprising:

a non-transitory machine-readable storage medium that stores instructions which, when executed by a processor in a computer, determine a layout of a first speaker array and a second speaker array, wherein the first speaker array and the second array have respective speaker cabinets and are movable relative to each other within the listening area;

generate one or more sets of audio beam pattern attributes based on the determined layout; and generate one or more drive signals for driving the first speaker array and the second speaker array with the one or more sets of audio beam pattern attributes such that each speaker array directs respective audio beams corresponding to one or more channels of the one or more pieces of sound program content in the listening area.

18. The article of manufacture of claim 17, wherein each set of the audio beam pattern attributes in the one or more sets of audio beam pattern attributes includes one or more of gain values, delay values, beam type pattern values, or beam angle values that are used to generate corresponding audio beams for each channel of the one or more pieces of sound program content.

19. The article of manufacture of claim 17 further comprising:

determining one or more parameters describing the audio system, wherein the one or more parameters describing the audio system include 1) a location of each of the speaker arrays relative to each zone and 2) a location of each audio source relative to corresponding zones, and wherein the one or more sets of audio beam pattern attributes are based on the one or more parameters describing the audio system.

20. The article of manufacture of claim 17, wherein the non-transitory machine-readable storage medium stores further instructions which, when executed by the processor:

determine parameters for the one or more pieces of sound program content, wherein the one or more sets of audio beam pattern attributes are generated based on the parameters for the one or more pieces of sound program content, wherein the parameters for the one or more pieces of sound program content include one or more of a number of channels in each piece of sound program content, a frequency range of each piece of sound program content, or a content type of each piece of sound program content.

21. The article of manufacture of claim 17, wherein the non-transitory machine-readable storage medium stores further instructions which, when executed by the processor:

determine parameters for the listening area, wherein the one or more sets of audio beam pattern attributes are generated based on the parameters for the listening area, wherein the parameters for the listening area include one or more of 1) a size and a geometry of the listening area; 2) reverberation characteristics of the listening area; or 3) a location of users in the listening area.

22. The article of manufacture of claim 21, wherein the non-transitory machine-readable storage medium stores further instructions which, when executed by the processor:

define each of the plurality of zones in the listening area, wherein the definition of each zone includes one or more of a location of the zone in the listening area, a size of the zone, a shape of the zone, or a piece of sound program content from the one or more pieces of sound program content associated with the zone.

23. The article of manufacture of claim 22, wherein each zone is defined based on one or more of 1) a location of one or more of the users in the listening area or 2) a location of one or more of the audio sources in the listening area.

24. The article of manufacture of claim 17, wherein the non-transitory machine-readable storage medium stores further instructions which, when executed by the processor:

detect a change to the zones or the audio system;

determine, in response to detecting the change to the zones or the audio system, parameters describing the zones and the audio system;

generate one or more new sets of audio beam pattern attributes based on the determined parameters for the zones and the audio system; and generate one or more drive signals for driving the first speaker array and the second speaker array with the one or more new sets of audio beam pattern attributes such that audio beams corresponding to one or more channels of the one or more pieces of sound program content are played in corresponding zones in the listening area.

* * * * *